US007611043B2

(12) United States Patent
Black

(10) Patent No.: US 7,611,043 B2
(45) Date of Patent: Nov. 3, 2009

(54) MAIL BOX AND MAIL BOX STANDARD PROTECTIVE APPARATUS

(75) Inventor: Jeffrey H. Black, 4753 Waldamere Ave., Willoughby, OH (US) 44094

(73) Assignee: Jeffrey H. Black, Willoughby, OH (US)

( * ) Notice: Subject to any disclaimer, the term of this patent is extended or adjusted under 35 U.S.C. 154(b) by 0 days.

(21) Appl. No.: 12/135,588

(22) Filed: Jun. 9, 2008

(65) Prior Publication Data

US 2008/0314967 A1 Dec. 25, 2008

Related U.S. Application Data

(60) Provisional application No. 60/936,914, filed on Jun. 22, 2007.

(51) Int. Cl.
*A47G 29/14* (2006.01)

(52) U.S. Cl. ..... 232/38

(58) Field of Classification Search ..... 232/39, 232/38, 17, 45, 29; 404/6; 150/154; D99/43
See application file for complete search history.

(56) References Cited

U.S. PATENT DOCUMENTS

| | | | | |
|---|---|---|---|---|
| 3,107,848 | A * | 10/1963 | Penta | 232/17 |
| 4,187,978 | A | 2/1980 | Dowker | |
| 4,368,842 | A | 1/1983 | DeLange, III | |
| 5,143,285 | A | 9/1992 | Wise | |
| 5,148,974 | A * | 9/1992 | Clapper | 232/17 |
| 5,206,377 | A | 4/1993 | McAfee | |
| 5,460,326 | A | 10/1995 | Albanesius | |
| D365,190 | S | 12/1995 | Albanesius | |
| 6,109,519 | A | 8/2000 | McClure | |
| D449,727 | S * | 10/2001 | Carlson | D99/29 |
| 6,308,884 | B1 | 10/2001 | Hamburger | |
| 6,808,108 | B1 * | 10/2004 | Turnbow et al. | 232/29 |
| 6,974,073 | B1 * | 12/2005 | Snyder | 232/29 |
| 7,080,773 | B1 * | 7/2006 | Tepley | 232/17 |
| 2006/0186188 | A1 * | 8/2006 | Belanger | 232/38 |
| 2008/0149697 | A1 * | 6/2008 | Webber | 232/39 |

* cited by examiner

*Primary Examiner*—William Miller
(74) *Attorney, Agent, or Firm*—Fay Sharpe LLP; Karl W. Hauber

(57) ABSTRACT

According to the present disclosure impact damage to a mail box and an associated support column can be prevented or at least minimized. In addition, adverse weather related affects can be minimized by the provision of a device comprising a shield having an arcuate form in a mounted position for shielding the mail box and at least a portion of the associated supporting column extending therefrom. The device includes a first leg extending along one side of the supporting column and the mail box and a second leg extending along another opposing side of the column and the mail box. A connecting member is provided and includes an arcuate portion connecting the first leg and the second leg for absorbing and deflecting the impact of collisional objects. The arcuate portion extends over and above at least a top side of the mail box.

20 Claims, 5 Drawing Sheets

MAIL BOX AND MAIL BOX STANDARD PROTECTIVE APPARATUS

The present application claims priority to the provisionally filed U.S. application Ser. No. 60/936,914 filed on Jun. 22, 2007.

This disclosure relates to novel constructions for shielding standard mounted rural type or curb side mail boxes from impact damage due to snow plow debris, natural forces, and drive-by vandalism, which in the absence of such shielding constructions would in many instances impair, destroy, or impede the functionality of the mail box and/or result in serious disfigurement of the mail box.

Roadside signs and mail boxes are often damaged by impact of debris, e.g. ice, snow, rocks, sand, and the like, thrown up by snow plows working close to the edge of a road. Also, drive-by vandalism of mail boxes by vandals using clubs and bats to strike the mail boxes off their posts is becoming increasingly common. Some examples of prior protectors for mail boxes and signs are as follows:

U.S. Pat. No. 4,187,978 discloses a flexible shield or cage surrounding a portion of a mail box which utilizes a hinge and shear pin arrangement; U.S. Pat. No. 4,368,842 discloses a cage formed of spaced apart impact resistant members surrounding a mail box; and, other examples include U.S. Pat. Nos. 5,460,326, 6,109,519, 6,308,884, 5,143,285, 5,206,377, and Des 365,190.

However, the preceding patents utilize complex and cumbersome mounting mechanisms or fail to sufficiently protect the entire sign or mail box, along with an associated mounting post or mail box standard, and only protect the receptacle for the sign or mail box. The preceding patents also fail to shield the mail boxes from unwanted accumulation of snow debris around the mail box and supporting structure.

The present apparatus is designed and configured to eliminate costly damage to rural mail boxes and the associated supports or mounting posts therefor when impacted by snow plow debris, clubs/bats, and projectiles. In many cases the mounting posts or mail box standards are decorative and are at least as valuable as the mail box mounted thereto.

The U.S. Postal Service requires replacement of damaged mail boxes, if mail service is to be continued. In some areas of the country experiencing heavy snowfalls, the damage inflicted on rural mail boxes during the winter season by snow plows gives rise to an annual spring ritual of mail box replacement or repair.

Vandalism is also a year round occurrence and is difficult to deter. Frequently the vandal uses a baseball bat or similar club like weapon to strike the mail box denting or even crushing the rather thin gauge metal (e.g. 22 gauge), or plastic, used in the mail box construction.

There is no known patent art relating specifically to flexible, semi-rigid, or rigid impact resistant and/or protective shields for rural mail boxes and their associated mounting posts. The present disclosure provides a shield, shroud, or panel for the protection of the mail box and associated mounting post, support column, or mail box standard and is so configured as to provide an impact barrier between the impact force and the exterior surfaces of a rural type mail box. The shield can be adapted for attachment to the usual mail box standards and/or attachment to the ground for rural type mail boxes in such manner that any impact force exteriorly applied to the shield is deflected, resisted, absorbed and/or dampened.

SUMMARY

The present disclosure provides a device for protecting a mail box and an associated support column. The device comprises a shield having an arcuate form in a mounted position for shielding the mail box and at least a portion of the associated supporting column extending therefrom. The device includes a first leg extending along one side of the supporting column and the mail box and a second leg extending along another opposing side of the column and the mail box. A semi-rigid member is provided and includes an arcuate portion connecting the first leg and the second leg for absorbing and deflecting the impact of collisional objects. The arcuate portion extends over and above at least a top side of the mail box. The devices further include a first series of apertures at a distal end of the first leg and a second series of apertures at a distal end of the second leg. A mounting arrangement is also provided including a first mounting anchor extending from at least one of the first series of apertures and a second mounting anchor extending from at least one of the second series of apertures. The first and second anchors are adapted for extending into the ground surface adjacent to the mail box and the support column.

The present disclosure further provides a method for preventing snowplow debris from striking a mail box. The method comprises providing a mail box assembly including at least one mail box housing and at least one vertical support post attached to the at least one mail box housing. The method further comprises providing a continuous arcuate panel having a first leg, a second leg, a top member, a fore edge and an aft edge, wherein the first leg and the second leg have substantially the same height. The top member extends above the at least one mail box housing. The top member provides a continuous connection between the first leg and the second leg to limit a maximum relative distance therebetween and is positioned such that the top member remains proximal to a top side of the at least one mail box for deflecting the snowplow debris from all sides of the mail box.

The present disclosure still further provides a method of preventing snowplow debris from striking a mail box. The method comprises providing a mail box assembly including at least one mail box housing and at least one vertical support column for mounting the at least one mail box housing thereto. The method further comprises providing an arcuate panel having a first leg, a second leg, a top member, a fore edge and an aft edge. The first and second legs can have substantially the same height. The top member connects the first and second legs and extends above the at least one mail box housing. The method still further comprises providing a pair of anchors wherein each of the anchors has a bottom end and a top end. The top end of one of the anchors being fixedly and directly attached to a side of the first leg and the top end of the other of the anchors being fixedly and directly attached to a side of the second leg. The method further provides for extending the bottom ends of each of the anchors into the ground surface proximal to the vertical support column.

The present disclosure still further provides a device for protection of a mail box and an associated support column. The device comprises a shield having an arcuate form in a mounted position for shielding the mail box and at least a portion of the associated support column extending therefrom. The shield includes a first leg extending along one side of the support column and the mail box and a second leg extending along another opposing side of the support column and the mail box. The shield can include a spring member hingedly connecting the first leg and the second leg for damping the initial impact of collisional objects. The spring member comprises a curved portion extending over and above a top side of the mail box.

BRIEF DESCRIPTION OF THE DRAWINGS

In the accompanying drawings, in which are shown various illustrative embodiments of this disclosure.

DETAILED DESCRIPTION

Figure 1:
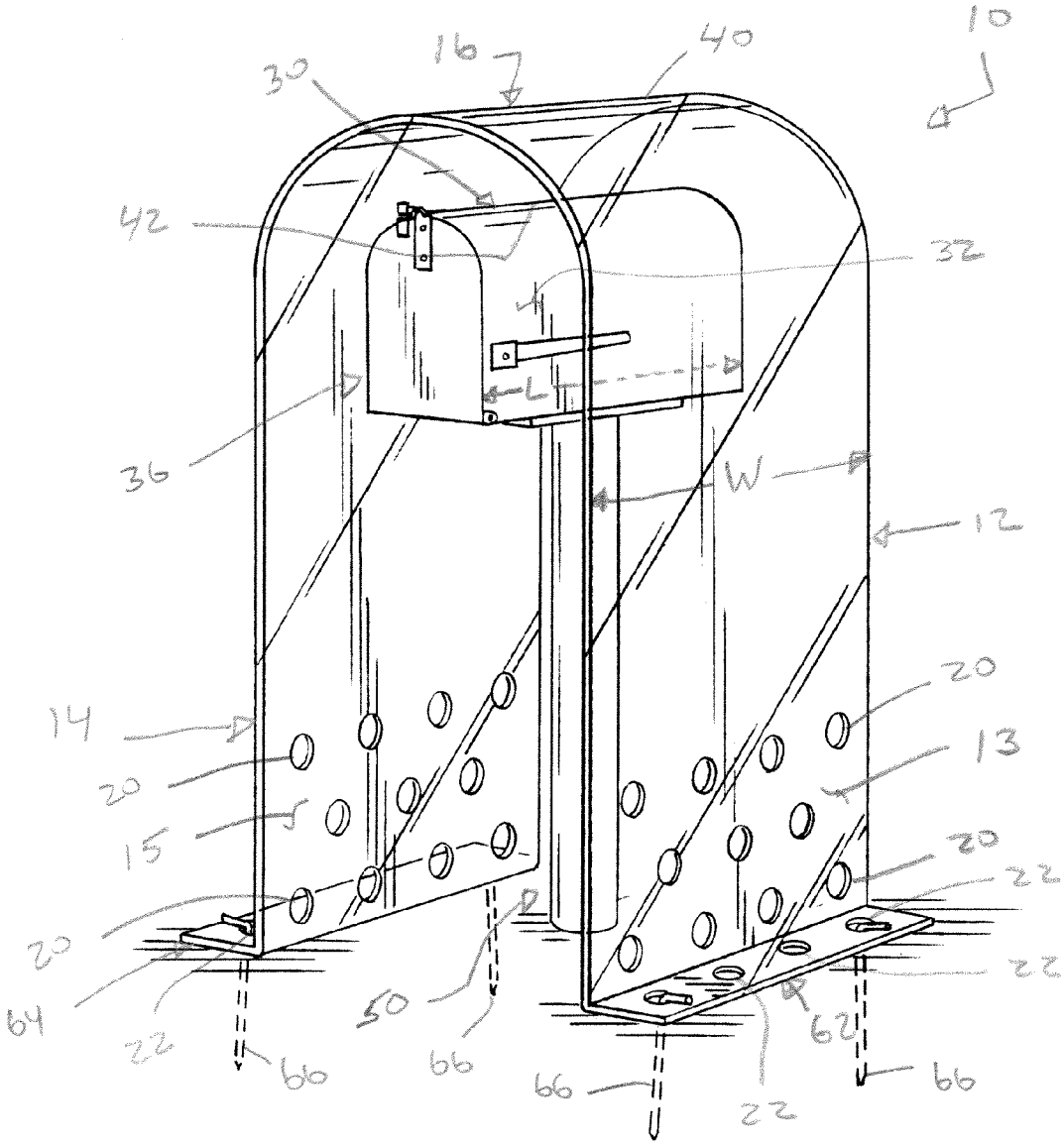
FIG. 1 is a perspective view of a rural type mail box mounted on a mail box standard and surrounded by a shield according to a first embodiment.
Figure 2:
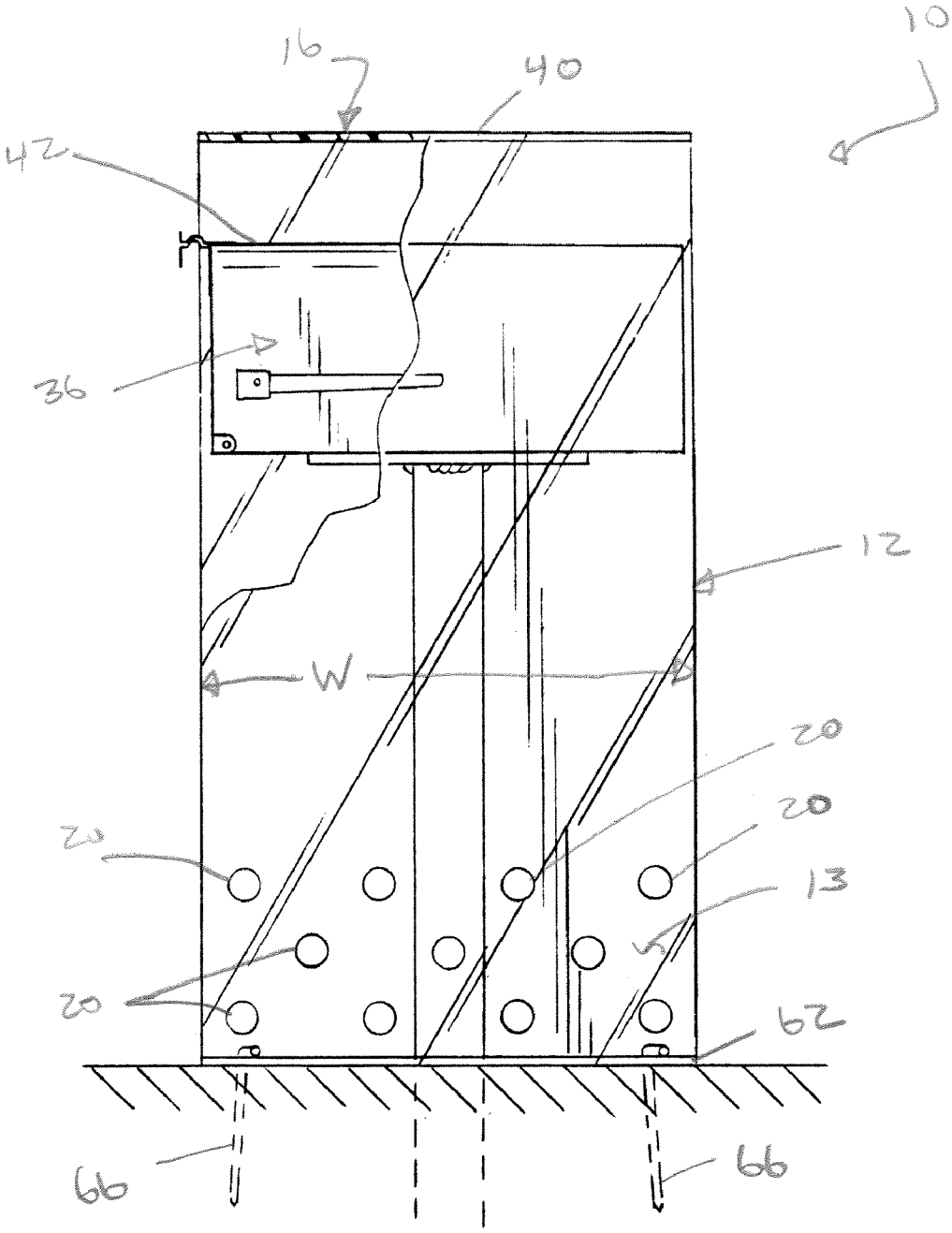
FIG. 2 is a side view of the same rural type mail box and protective shield as in FIG. 1.

Referring now in detail to the drawings, the presently described shield or panel, in one embodiment, is illustrated by FIGS. 1 and 2 and designated as 10 in each instance. As shown, the shield 10 comprises an arched configuration having first and second legs 12, 14. A connecting or top portion 16 having an arcuate form connects the first and second legs 12, 14. The top portion 16 is bent or shaped to conform generally to the curvature of a top 30 and parallel sides 32, 34 of a typical rural mail box 36. An apex 40 of the shield 10 is positioned approximately adjacent to the apex or top 42 of the associated mail box 36. The first and second legs 12, 14, along with the connecting top portion 16 provides a continuous and seamless panel or shield 10 that shrouds the associated mail box 36 and a mail box standard 50 or mounting post connected thereto. The width W of the shield 10 corresponds substantially to the depth or length L of mail box 36, but if desired can extend some distance beyond each end of mail box 36 to provide additional impact protection against impact forces directed mainly against either the front or rear ends of the mail box 36. An extension 121 (see FIG. 3) over either end of the mail box 36 can act to serve as a canopy or 'awning' thereby providing additional protection from the elements and snow plow debris.

The bottom areas 13, 15 of the first and second legs 12, 14 can be provided with drilled, punched, or molded apertures 20, 22. The apertures 20, 22 enable shield 10 as shown in FIG. 2 to be mounted to the ground. The apertures 20 also enable one side or leg to be fastened to the other opposing side or leg (refer to FIG. 4). It is to be appreciated that the series of apertures 20, 22 enables a large degree of flexibility and adjustment of the shield whether mounted to the ground, mounted one leg to another leg, and/or mounted to the mail box standard 50. The apertures 20, 22 also enable fore and aft adjustment mounting such that the shield 10 can be moved fore and aft relative to the mail box 36 in order to accommodate, for example, a center mounted standard 50 or rear mounted/positioned standards 150, 250. The series of apertures 20, 22 enables adjustment of the shield's position to accommodate different types of mail box mounting arrangements to the standard, i.e. a mail box hanging from a horizontal wood support beam extending from a vertical post 250 (refer to FIG. 5). The apertures 20, 22 also allow air and water to pass therethrough thereby providing a structure more resistant to wind forces and accumulation of rain and melting snow.

Referring again to FIG. 1 wherein one example of a mounting arrangement is therein shown. In this example, the shield 10 can be mounted to the ground for obtaining a strong impact resistant mounting of shield 10 to the ground. As shown in the FIGS. 1 and 2, the first leg 12 and the second leg 14 can include a first foot 62 and a second foot 64, respectively, at each end. The feet 62, 64 can include apertures 22 provided for mounting anchors 66, at one end, in any number of selective positions thereto. The mounting anchors 66 at the other opposing end can be driven into the ground. The mounting anchors 66 can be selectively and positionally placed in any one or more apertures in order to accommodate the preferred position of the shield relative to the mail box 36 and mail box standard 50, as well as, accommodate any structural elements proximal to the base of the mail box standard 50.

Maximum shielding from snowplow debris, or similar, and maximum protection against any denting of mail box 36 is to be found in the arch shaped structure depicted in the drawings. All side surfaces of mail box 36 are completely shielded by the panel 10 which can be spaced from the surface of mail box 36 as shown in the FIGURES, but if desired it can be in actual contact with the external surfaces of mail box 36. In order to resist denting from the type of damage force usually inflicted on mail boxes, shield 10 can have a nominal thickness of about ⅛th inch but obviously still greater protection is obtained with increased thickness of the plastic panel, i.e. ¼th to ½ inch. In one example, the shield can comprise a plastic material reinforced as for example by fiber glass cloth or fiber glass strands, carbon fibers or steel mesh and included a nominal thickness of at least about 3/16th inch.

In one embodiment, shield 10 is constructed of high impact strength plastic materials. Among the suitable plastic materials useful for the construction of a shield according to the present disclosure are the polyolefins such as polyethylene, polypropylene and modified copolymers thereof, polyamides such as nylon 6-6, polycarbonates, polysufones, polyacrylics, vinyl halide polymers and copolymers, ABS polymers, epoxies, heat-hardenable phenol-aldehyde resins, urea-formaldehyde resins and melamine aldehyde resins. All of these plastics may be used in combination with impact reinforcing fillers such as glass fiber, nylon or polyester fiber, carbon fiber or metal fibers to further enhance their impact and flexural strengths. The plastic may be used as the binder component in laminated structures of paper, organic or inorganic fabric, or wood as in plywood structures.

As a substitute for plastic in the construction of the shield, the use of wood or metal materials is within the contemplation of this disclosure, provided that such materials are utilized in a manner as to provide impact protection substantially equivalent to that obtainable from the use of plastic materials. If it is desired to have a metal shield of the same width as the plastic shield, then the metal shield thickness could be a relative fraction thereof of the plastic thickness, for example, of the order of four or more depending on the flexural and tensile strength values of the particular metal material.

The FIGURES depict a shield structure forming an arch shaped panel 10 such that the first leg 12, top member 16, and second leg 14 can be molded into a unitary structure as by plastic injection molding techniques. The shield can alternatively be cast from any suitable sheet metal including, for example, steel, tin, or aluminum. The shield can comprise a width and a thickness such that the cross-sectional area formed from a suitable plastic molding material not only has a high impact strength at summer temperatures, but also does not become brittle at or below freezing temperatures.

If a flexible or semi-rigid material is used for the shield, the top member 16 acts as a spring or impact absorption mechanism. Upon impact to one of the legs 12, 14, the shield 10 absorbs the force by allowing the legs 12, 14 and the top member 16 to deflect and push back against the mail box standard 50. The one-piece shield or shroud 10 about the mail box 36 and mail box standard 50 having legs 12, 14 disposed respectively parallel and in spaced relation to the opposite side faces of the mail box 36, enables a portion of the impact from an object striking a first leg 12 on one side of the shield to be transmitted to the oppositely disposed leg 14 through flexible top or spring member 16. Upon completion of the impact, the shield 10 releases back to the original position. A flexible or semi-rigid material also allows the shield 10 to conform to other shapes so as to, for example, protect side-by-side mail boxes or side-by-side mail box and newspaper receptacle.

Figure 3:
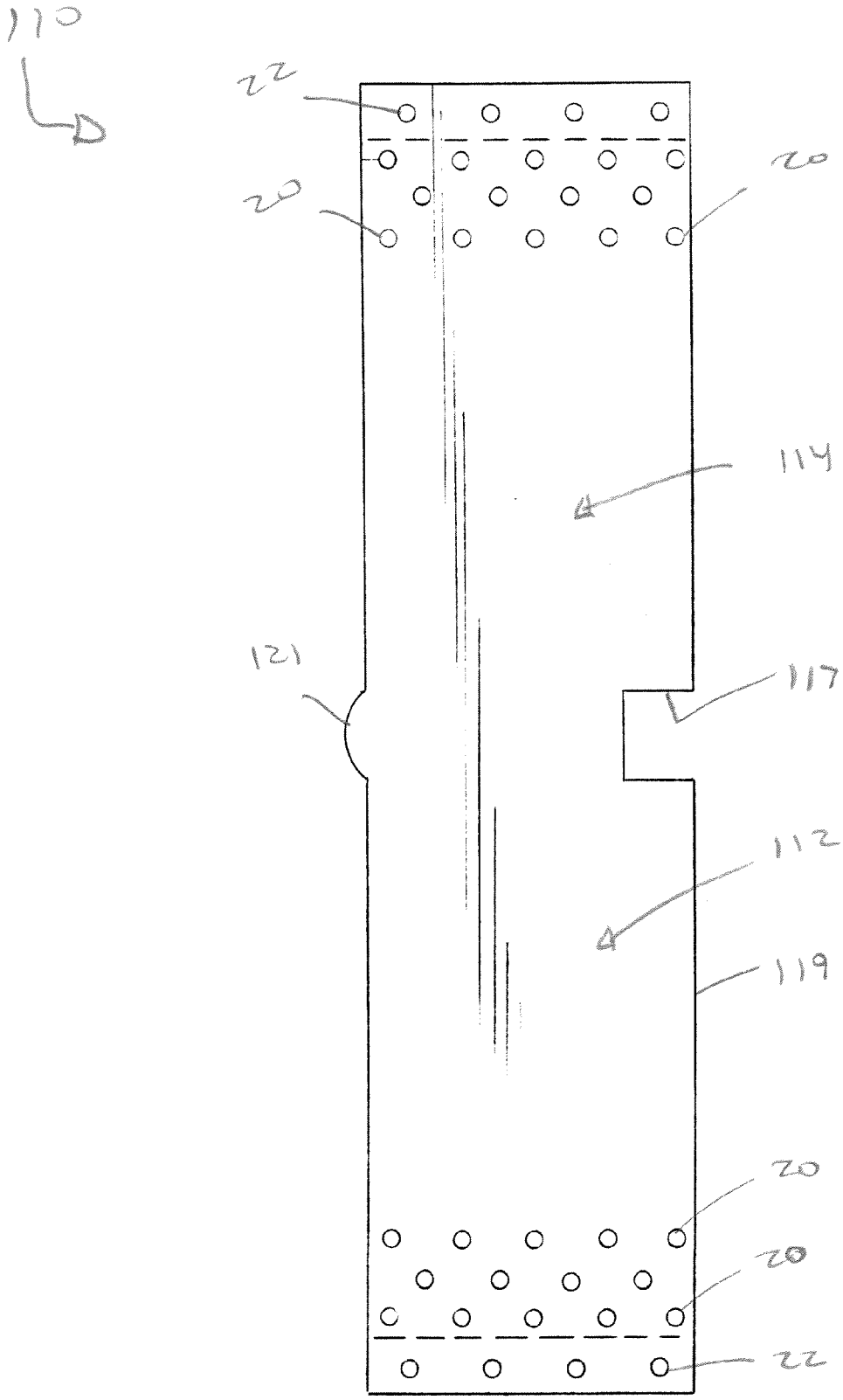
FIG. 3 is a detailed top plan view of a shield according to a second embodiment.
Figure 4:
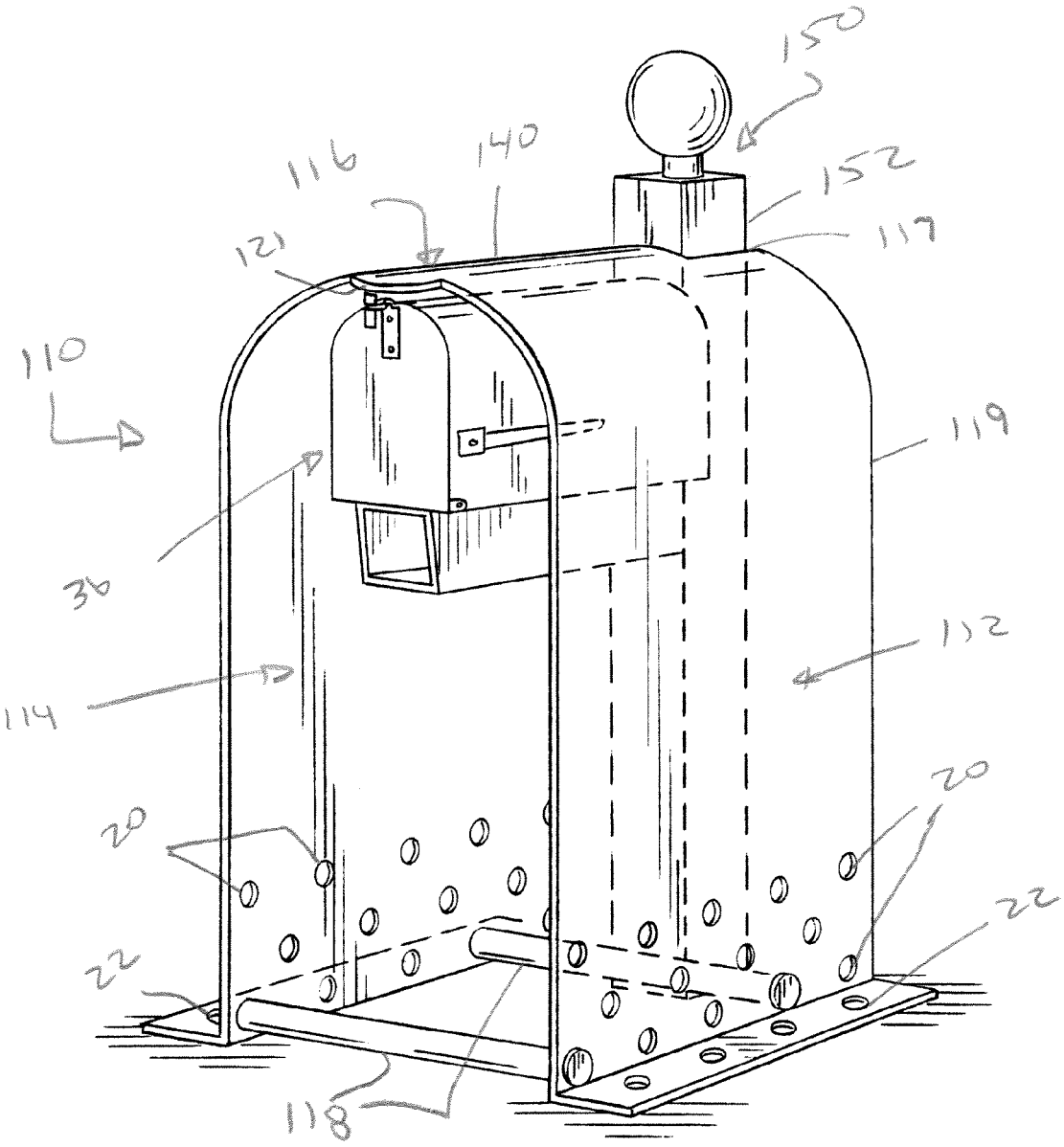
FIG. 4 is a perspective view of the shield shown in FIG. 3 surrounding a mail box and another mail box standard; and, FIG. 5 is a side view of the shield of FIG. 3 surrounding a rural mail box and still another mail box standard.

Referring to FIGS. 3 and 4 there is shown another embodiment of a shield 110 and another mounting position for mounting shield 110 around a mail box standard 150 and mail box 36. In this embodiment, the arched top portion 116 includes a cutout or notch 117 along the aft edge 119. The cutout 117 is generally centered proximal to the apex 140 of the shield 110 in the mounted position. The cutout 117 provides for fore and aft movement of the shield 110 and for enabling placement of the shield 110 around a vertical post 152 of a rear oriented mail box standard 150. In this mounting arrangement the shield 110 provides protection to the mail box 36 and a majority of the mail box standard 150.

As discussed above, the protective shield 110 can be mounted without anchoring to the ground (FIG. 4). In this manner, one leg 112 can be connected to another leg 114 via connecting members 118 positioned in front of the mailbox standard 150 and/or behind the mail box standard 50. It is to be appreciated that in this arrangement each leg 112 can be anchored to the other opposing leg 114. The shield 110 can be selectively positioned fore and aft in order to provide the maximum protection to the mail box 36 and mail box standard 150.

It is to be appreciated that the shield 10, 110 can be easily mounted or anchored adjacent an existing mail box and standard. The shield 10, 110 does not require mounting to the mail box 36 or the mail box standard 50, 150. The shield 10, 110 does not require removal of the mail box 36 from the standard 50, 150 in order to mount the shield 10, 110. The shield 10, 110 can be free standing, self-supporting, or anchored into the ground. Accordingly, it is rather evident that the shield can be readily fabricated to match the configuration of any mail box whose design and mounting height have been approved by the U.S. Postmaster General. In addition, the shield 10, 110 does not restrict either end of the mail box and thereby allows access to a 'passthrough' type of mail box wherein the postal carrier accesses the fore end of the mail box and the resident accesses the aft end of the mail box. The 'passthrough' also allows snow debris to move therethrough to avoid detrimental accumulation under the shield.

Figure 5:
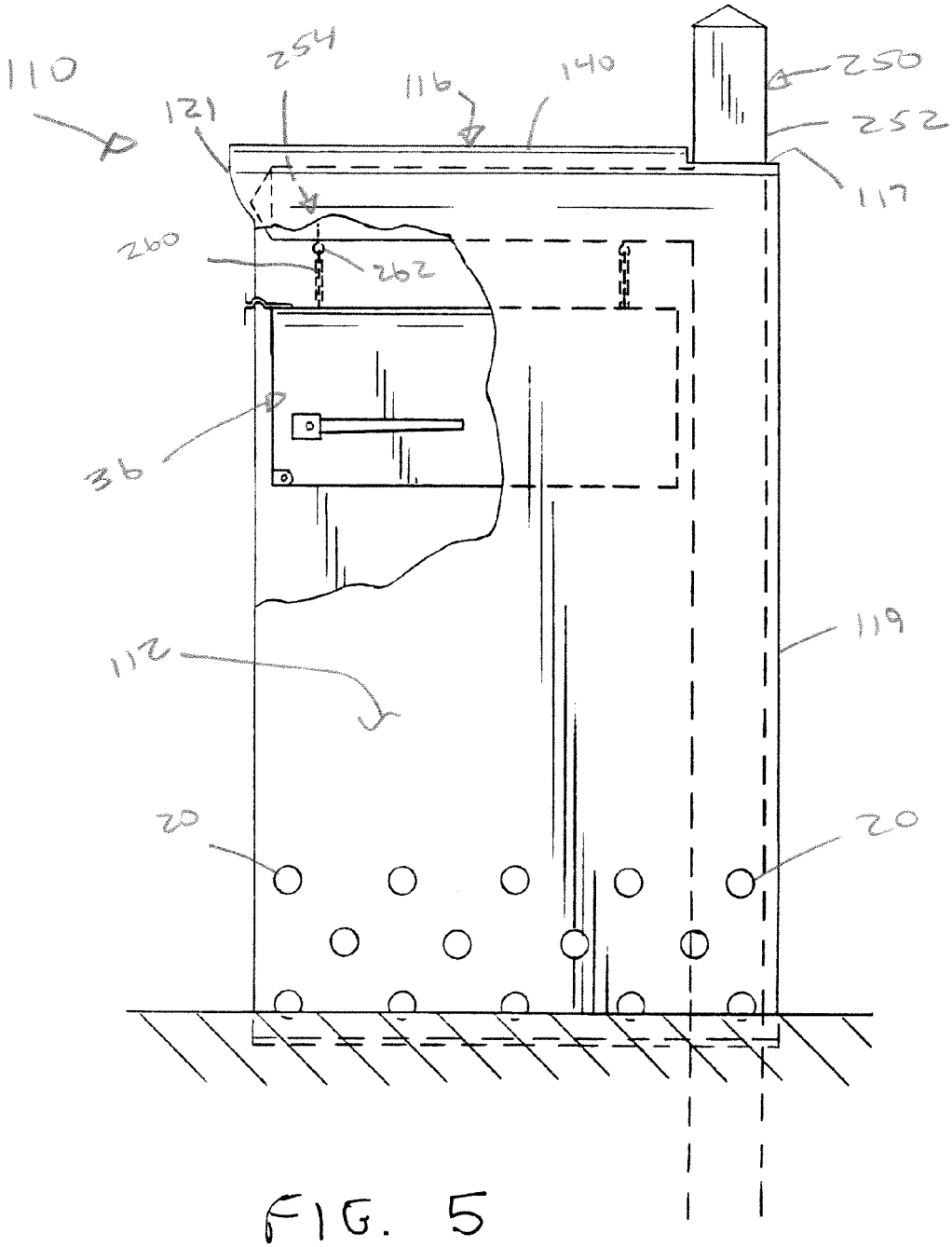

A chain type mounting of mail box 36 is illustrated in FIG. 5. Another mail box standard 250 is therein shown and includes a vertical post 252 having attached thereto a horizontal beam 254 extending somewhat beyond the front end of mail box 36. Near the front end of beam 254, one end of a chain 260 is attached thereto by means of a screw eye 262. The other end of the chain has an eye bolt attached thereto and is insertable into mating apertures through the top of mail box 36 wherein the inserted eye bolt can be retained, for example, in position by a nut and washer (not illustrated). A rear chain is similarly fastened to the top of mail box 36. The mail box suspension attachment system illustrated in FIG. 5, as with the other attachment systems herein described, is adequately accommodated by the aforementioned embodiments of the shield 10, 110 and the associated mounting arrangements.

The aforementioned description provides an apparatus for a protective device for a mail box or sign. As previously described, various problems exist for protective devices for signs or mail boxes. For example, they fail to sufficiently protect the entire sign or mail box, and/or only protect the receptacle for the sign or mail box. Likewise, they fail to give proper notice of address and other information. In contrast, in one aspect, the claimed subject matter depicts a protective shield 10, 110 that is sturdy and easy to assemble and offers various mounting options. The claimed subject matter depicts a panel or shield 10, 110 coupled to support anchors 66, 118 via a series of apertures 20, 22 extending through the legs or feet of the shield. In one exemplary embodiment, the protective shield can utilize at least one of the legs 12, 112, 14, 114 to display a customized message, poster or sign, and may include an address, name plate, and/or outgoing mail flag indicator (not illustrated). Likewise, in another embodiment, a photoelectric cell light or reflector may be coupled to the protective shield to offer illumination or attention for an address.

In one exemplary arrangement, the protective device 10, 110 can be positioned such that the top member extends generally 60 inches in height. The shield can generally be 30 inches in width. The support anchors may comprise 1 inch pipe, rebar, stakes, or similar. In alternative embodiments, the top member may be flat shaped. The claimed subject matter is not limited to the previously described mounting positions/locations. For example, multiple shields, such as two, can be positioned in series so as to form a 'deeper' shield around the mail box(s).

While certain exemplary embodiments have been described and shown in the accompanying drawings, it is to be understood that such embodiments are merely illustrative of and not restrictive on the broad disclosure, and that this disclosure not be limited to the specific constructions and arrangements shown and described, since various other modifications may occur to those ordinarily skilled in the art upon studying this disclosure or from the scope of the appended claims.

I claim:

1. A device for protection of an associated mail box and an associated support column comprising:

a shield having an arcuate form in a mounted position adapted for shielding the associated mail box and at least a portion of the associated supporting column extending therefrom;

said shield including a first leg extending along one side of the associated supporting column and the associated mail box and a second leg extending along another opposing side of the associated column and the associated mail box;

said shield including a semi-rigid member comprising an arcuate portion connecting said first leg and said second leg for absorbing and deflecting the impact of collisional objects;

said arcuate portion extending over and above at least a top side of the associated mail box;

said device including a first series of apertures at a distal end of said first leg and a second series of apertures at a distal end of said second leg; and, a mounting arrangement comprising a first mounting anchor extending from at least one of said first series of apertures and a second mounting anchor extending from at least one of said second series of apertures, said first anchor at one end coupled to said first leg and said second anchor at one end coupled to said second leg, said first and second anchors each at another end adapted for extending into the ground surface adjacent to the mail box and the support column.

2. The device of claim 1, wherein said first leg, said second leg, and said semi-rigid member form an arch shaped shield wherein said first leg and said second leg respectively disposed on opposite sides and in spaced relation to the associated mail box.

3. The device of claim 1, wherein said first and second series of apertures respectively extend from a front edge to a back edge of said first and second legs for fore and aft selective adjustment of the position of said device relative to the mail box.

4. The device of claim 3, wherein said arcuate portion includes a rear cutout section offset from said respective rear edges of said first leg and said second leg for accommodating the associated supporting column which is a rear mounted support column.

5. A method of preventing snowplow debris from striking a mail box, said method comprising:

providing a continuous arcuate panel having a first leg, a second leg, a top member, a fore edge and an aft edge, wherein said first leg and said second leg having substantially the same height, said top member extending above an associated at least one mail box housing;

wherein said top member providing a continuous connection between said first leg and said second leg to limit a maximum relative distance therebetween and such that said top member remains proximal to a top side of the associated at least one mail box for deflecting the snowplow debris from all sides of the associated at least one mail box;

providing an anchoring arrangement comprising an independent mounting means separate from the associated mail box and associated support column, wherein said mounting means and said arcuate panel form a self-supporting device; and, said anchoring arrangement and said arcuate panel independently absorb at least some of the impact forces resulting from the snow debris.

6. The method according to claim 5, wherein said top member resiliently connecting said first leg and said second leg thereby providing a damping effect to the initial impact of the snowplow debris.

7. The method according to claim 6, wherein said mounting means comprises:

said first leg including a plurality of spaced apart apertures extending substantially from said fore edge to said aft edge;

said second leg including a plurality of spaced apart apertures extending substantially from said fore edge to said aft edge; and, a mounting member selectively mountable to any one of said first leg apertures and any one of said second leg apertures respectively for selective placement of said panel proximal to the associated at least one mail box.

8. The method according to claim 7, wherein said panel has a width from said fore edge to said aft edge and the associated at least one mail box housing having a length, said width substantially equal to said length.

9. The method according to claim 5, wherein said top member rigidly connecting said first leg and said second leg thereby providing impact resistance to the snowplow debris.

10. The method according to claim 5, wherein each of said legs extends below the associated at least one mail box housing and along a portion of opposing sides of said vertical support post whereby part of the impact upon one of the first or second legs will be transmitted directly to the other opposing first or second legs.

11. A method of preventing snowplow debris from striking a mail box, said method comprising:

providing an arcuate panel adapted for shielding an associated at least one mail box housing and an associated at least one vertical support attached to the at least one mail box housing;

wherein said arcuate panel having a first leg, a second leg, a top member, a fore edge and an aft edge, said first leg and said second leg having substantially the same height, said top member connecting said first and second legs and extending above the associated at least one mail box housing;

providing a pair of posts, each of said posts having a bottom end and a top end, said top end of one of said posts being fixedly and directly attached to a side of said first leg and said top end of the other of said posts being fixedly and directly attached to a side of said second leg; and, extending said bottom ends of each of said posts into the ground surface proximal to the associated vertical support.

12. The method according to claim 11, wherein said top member resiliently connecting said first leg and said second leg thereby providing a damping effect to the initial impact of the snowplow debris.

13. The method according to claim 11, wherein said top member rigidly connecting said first leg and said second leg thereby providing an impact deflection effect to the snowplow debris.

14. A device for protection of an associated mail box and an associated support column comprising:

a shield having an arcuate form in a mounted position adapted for shielding the associated mail box and a majority of the associated supporting column extending therefrom;

said shield including a first leg extending along one side of the associated supporting column and the associated mail box and a second leg extending along another opposing side of the associated column and the associated mail box; and, a spring member hingedly connecting said first leg and said second leg for damping the initial impact of collisional objects, said spring member comprising a curved portion extending over and above a top side of the associated mail box.

15. The device according to claim 14, wherein said shield including a first series of apertures at a distal end of said first leg and a second series of apertures at a distal end of said second leg; and, a mounting member extending from said first leg to said second leg for securing said device proximal to the associated support column.

16. The device according to claim 15, wherein said first and second series of apertures respectively extend from a front edge to a back edge of said first and second legs for fore and aft adjustment of the position of said device with the associated mail box.

17. The device according to claim 14, wherein said first leg, said second leg, and said spring member form an arch shaped shield having said first and second legs respectively disposed on opposite sides and in spaced relation to the associated mail box.

18. The device according to claim 17, wherein said spring member includes a rear edge portion offset from respective rear edges of said first leg and said second leg, said spring member rear edge accommodates the associated support column.

19. The device according to claim 18, wherein said shield is coated with an iridescent material to enhance visibility of said device by drivers of vehicles and maintenance equipment at night.

20. A device for protection of an associated mail box and an associated support column comprising:

a shield having an arcuate form in a mounted position adapted for shielding the associated mail box and at least a portion of the associated supporting column extending therefrom;

said shield including a first leg extending along one side of the associated supporting column and the associated mail box and a second leg extending along another opposing side of the associated column and the associated mail box;

the associated supporting column includes a height wherein at least one of said first and said second legs extends along a majority of the height of the associated supporting column;

said shield including a semi-rigid member comprising an arcuate portion connecting said first leg and said second leg for absorbing and deflecting the impact of collisional objects; and, said arcuate portion extending over and above at least a top side of the associated mail box.

* * * * *